US007410553B2

(12) United States Patent
Blanpied et al.

(10) Patent No.: US 7,410,553 B2
(45) Date of Patent: Aug. 12, 2008

(54) BUILDING CONSTRUCTION FELT PAPER WITH BIOCIDE/ANTI-MICROBIAL TREATMENT

(75) Inventors: Robert H. Blanpied, Suwanee, GA (US); Freddie Lee Murphy, Meridian, MS (US)

(73) Assignee: Atlas Roofing Corporation, Meridian, MI (US)

( * ) Notice: Subject to any disclaimer, the term of this patent is extended or adjusted under 35 U.S.C. 154(b) by 227 days.

(21) Appl. No.: 11/071,577

(22) Filed: Mar. 4, 2005

(65) Prior Publication Data

US 2006/0199454 A1 Sep. 7, 2006

(51) Int. Cl.
*D21C 5/02* (2006.01)
*D21G 1/02* (2006.01)
*B32B 27/04* (2006.01)

(52) U.S. Cl. ..... 162/100; 162/161; 162/189; 162/231; 427/359; 427/361; 442/123

(58) Field of Classification Search ..... 442/123; 162/100, 161, 189, 231; 427/359, 361
See application file for complete search history.

(56) References Cited

U.S. PATENT DOCUMENTS 6,413,531 B2 * 7/2002 King et al. ..... 424/405
6,572,736 B2 6/2003 Bush et al.
6,734,157 B2 5/2004 Radwanski et al.
2002/0059990 A1 5/2002 Bush et al.
2002/0062934 A1 5/2002 Bush et al.
2002/0099125 A1 7/2002 Akkapeddi et al.
2005/0126430 A1 * 6/2005 Lightner et al. ..... 106/15.05
2005/0170721 A1 * 8/2005 Toas et al. ..... 442/149

* cited by examiner

*Primary Examiner*—Ula C Ruddock
(74) *Attorney, Agent, or Firm*—Nixon & Vanderhye, P.C.

(57) ABSTRACT

A nonwoven web has a weight sufficient for construction industry use and comprises at least forty percent (40%) recycled waste paper. At least one surface of the web bears a biocide, e.g., has a biocide applied thereto. Preferably the weight of the web is greater than fifteen pounds per thousand square feet (15-lbs/MSF). Preferably the biocide is zinc pyrithione. The web preferably bears at least 50-grams of biocide per thousand square feet per side of said web. One example use of the web is as builders felt, with other uses including as a facer for a laminate board and for asphalt-impregnated webs. The biocide-bearing nonwoven web is specifically directed to use in building construction. One example use of the web is as builders felt, with other uses including as a facer for a laminate board and for asphalt-impregnated webs. Because building construction products must be tough, but priced as low as possible, this web is made largely from recycled waste paper (as opposed to virgin cellulose fiber, as a cost-reducing measure), and optionally clarifier sludge.

14 Claims, 6 Drawing Sheets

BUILDING CONSTRUCTION FELT PAPER WITH BIOCIDE/ANTI-MICROBIAL TREATMENT

BACKGROUND

1. Field of the Invention

The field of the invention pertains to building construction paper such as that often called Builder's Felt.

2. Related Art and Other Considerations

Many building construction professionals have used the various forms of a nonwoven continuous web, often impregnated with asphalt, as a layer to place underneath other building products such as shingles, sheathing, and flooring. Because of the usual location of the nonwoven web, i.e., underneath other products, it has been called "underlayment" or "underlay".

For many years prior art webs have served in building construction as a base material that is converted into roofing, siding, and flooring felt. In addition, various types of nonwoven continuous web sheets have also been used as a "facer" material for foamed insulation board laminates. In these foamed insulation board laminates, facer materials typically form a sandwich panel where the core material is comprised of polyisocyanurate foam. These foamed insulation laminates are typically utilized as side-wall or roofing insulation. The two facers of a laminated roof insulation board can be a glass fiber reinforced felt. One such facer material is made by Atlas Roofing Corporation, and is called "GRF (Glass-Reinforced-Felt) Facer".

A recently developed and popular nonwoven web is described in U.S. Pat. No. 6,572,736 to Bush et al. Prior art facer webs are listed in U.S. Pat. No. 6,572,736 and in U.S. patent application Ser. No. 09/971,771, both of which are incorporated herein by reference in their entirety.

Outside of the building construction arena, the practice of treating nonwoven web materials with anti-microbial chemicals has become more widespread as health standards have improved worldwide. For example, U.S. Pat. No. 6,734,157 treats nonwoven web materials with anti-microbial chemicals. However, the field of anti-microbial treated nonwoven webs for building products is relatively barren.

The principal biology responsible for the health problems in many buildings are fungi rather than bacteria or viruses. Reports have indicated that *Stachybotrys chartarum, Aspergillus versicolor*, and several toxigenic species of *Penicillium* are potentially hazardous, especially when the air-handling systems have become heavily contaminated.

Perhaps the most hazardous of the toxigenic fungi found in wet buildings is *Stachybotrys chartarum*, a fungus known to produce the very potent cytotoxic macrocyclic trichothenes along with a variety of immunosuppressants and endothelin receptor antagonists mycotoxins. This fungus was investigated for its association with the serious health problems of a family living in a water-damaged home in Chicago and has been implicated in several cases of building-related illness. Also, a cluster of cases of acute pulmonary hemorrhage/hemosiderosis was reported in Cleveland, Ohio.

While there has been some progress in nonwoven webs in personal hygiene technology, the control of molds and fungus in building construction nonwoven web products has yet to be substantially addressed. What is needed, therefore, and an object of the present invention, is a nonwoven web for building products that resists growth of fungi and molds, and a method of making the same.

BRIEF DESCRIPTION OF THE DRAWINGS

The foregoing and other objects, features, and advantages will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

BRIEF SUMMARY

Figure 1:
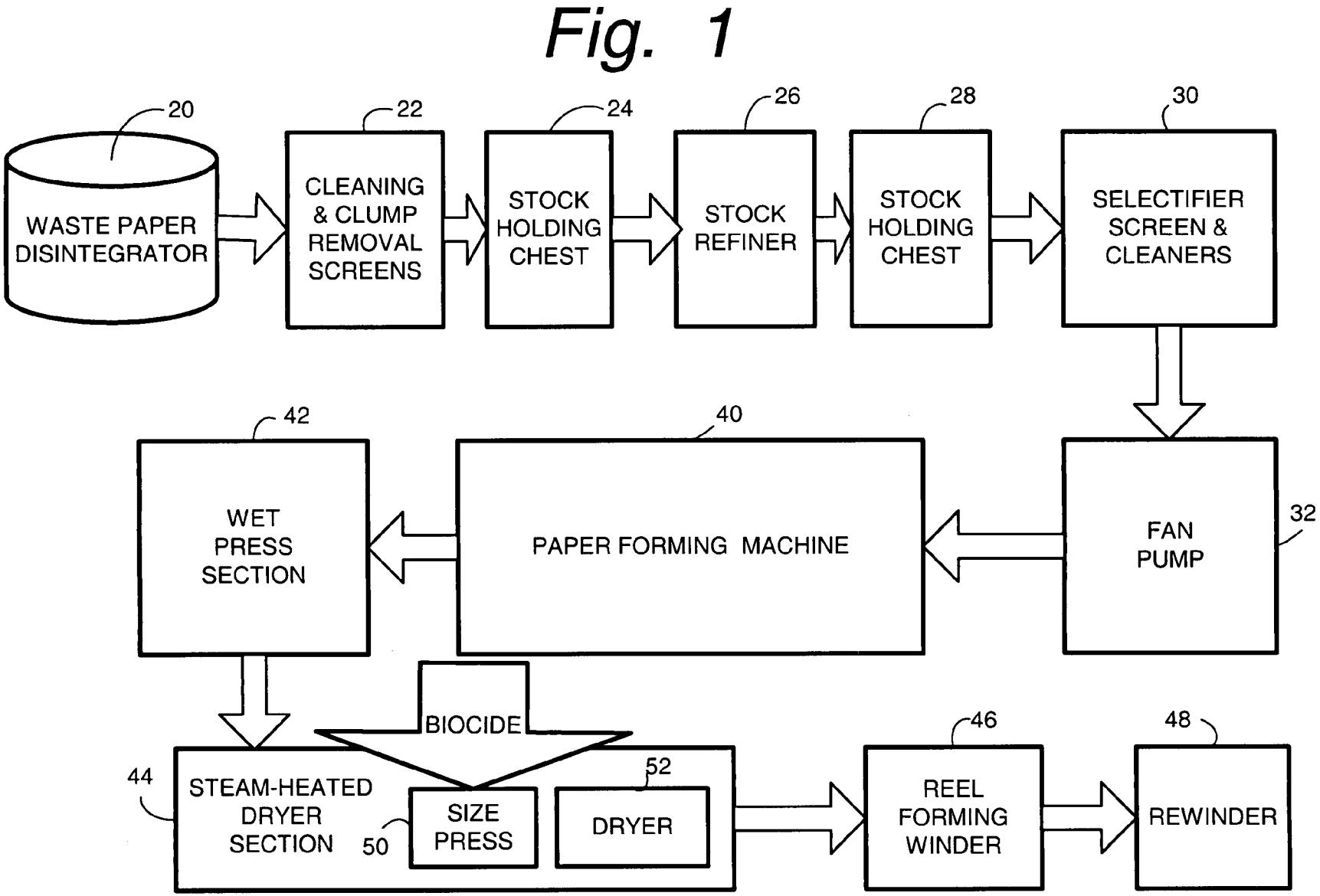
FIG. 1 is a schematic view of web making apparatus according to a first example embodiment of the technology.

A nonwoven web has a weight sufficient for construction industry use and comprises at least forty percent (40%) recycled waste paper. At least one surface of the web bears a biocide, e.g., has a biocide applied thereto or is treated with a biocide. Preferably the weight of the web is greater than fifteen pounds per thousand square feet (15-lbs/MSF). Preferably the biocide is zinc pyrithione. The web bears (on each side) at least 50-grams of biocide per thousand square feet of said web per web side to which it is applied. Depending on nature of web use, the biocide can be applied to one or both sides of the nonwoven web. The biocide-bearing nonwoven web is specifically directed to use in building construction. One example use of the web is as builders felt, with other uses including as a facer for a laminate board and for asphalt-impregnated webs. Because building construction products must be tough, but priced as low as possible, this web is made largely from recycled waste paper (as opposed to virgin cellulose fiber, as a cost-reducing measure), and optionally clarifier sludge.

DETAILED DESCRIPTION

In the following description, for purposes of explanation and not limitation, specific details are set forth such as particular compositions, techniques, etc. in order to provide a thorough understanding. However, it will be apparent to those skilled in the art that the present invention may be practiced in other embodiments that depart from these specific details. In other instances, detailed descriptions of well known substances and methods are omitted so as not to obscure the description of the present invention with unnecessary detail. It will be further understood that in the ensuing description and claims that the terms "web" and "mat" are employed interchangeably, and in the sense that the mats and webs can be used as "facers", all three terms may be utilized interchangeably. Likewise, the terms "biocide," "bactericide," and "fungicide" are employed interchangeably.

Described herein are nonwoven webs which are treated with one or more biocides to resist the growth of fungi and molds, and methods of making such webs. The nonwoven webs are largely comprised of recycled cellulose fiber, usually in the form of purchased waste paper. For the purpose of describing this technology, the term "recycled cellulose fiber" means either (1) post-consumer recycled waste paper and cardboard, or (2) pre-consumer but post-industrial recycled waste paper and cardboard, which is obtained from factories, or a combination of (1) and (2). An example of pre-consumer but post-industrial recycled waste paper and cardboard is the side-trim and clippings that come from paper converters. Preferably the non-woven webs are continuously produced in a conveyor-type paper forming machine.

Optionally, as described in U.S. Pat. No. 6,572,736 to Bush et al, untreated clarifier sludge may be added. Also optionally, either virgin or recycled glass fibers may be added. With or without glass fibers being added, the web can be subsequently saturated with asphalt and used as shingle underlayment, or used as either facer for laminated foam board or for unsaturated Builder's Paper, and sometimes used as flooring underlayment.

Many biocides are being phased out due to harmful side effects, and only a few new ones being considered for long term use. For example, ortho-Phenyl Phenol is rated by one of California's many hazardous materials watchdog organizations as a human carcinogen; however, the National Institute for Occupational Safety and Health (NIOSH) does not draw that conclusion. Thus the environmental concerns of the 21$^{st}$ century have reduced the number of biocides that can be seriously considered for use.

Evaluations were performed to ascertain some appropriate biocides for use with a nonwoven web. A preliminary screening resulted in a list which included twenty-four (24) compound groups, further collected into seven (7) different categories. They are listed in TABLE 1.

TABLE 1

| Biocides |
|---|
| 1. Metal containing compounds |
| a. Copper and zinc naphthenate and quinolinolate |
| b. Copper and zinc dimethyl dithiocarbamate |
| c. Tributyl tin oxide, fluoride, chloride and naphthenate |
| d. Phenylmercuric acetate |
| e. 10,10$^{1}$-oxybisphenoxarsine |
| f. Organoborons |
| 2. Phenolics |
| a. Phenol and homologues such as orthophenyl phenol, cresol and thymol |
| b. Trichlorophenol, pentachlorophenol, para-chloro-meta cresol, dichloro dihydroxy-diphenyl-methane |
| c. Parahydroxybenzoic acid and its salts, pentachlorphenyl laurate |
| d. Para-nitro-phenol, salicylanilide |
| 3. Quaternary ammonium compounds |
| a. Dialkyl dimethyl ammonium chloride |
| b. Alkyl dimethyl benzyl ammonium chloride |
| 4. Nitrogen containing compounds |
| a. 1,3,5-hexahydrotriazine and derivatives |
| b. Dodecylamine salicylate |
| c. Oxazolidines |
| d. Imidazolines |
| 5. Sulphur containing compounds |
| a. Bis(2 hydroxy-5-chloro-phenyl)sulphide |
| b. Hexachlorodimethyl sulphone |
| 6. Nitrogen and sulphur containing compounds |
| a. Tetramethylthiuram disulphide |
| b. N-(trichloromethyl)thiophthalimide (Folpet) and fluorine derivative |
| c. 8-hydroxyquinoline sulphate |
| d. Pyrithiones, Zinc and Sodium |
| e. Isothiazoline range |
| 7. Inorganic compounds |
| a. Metallic salts of copper, zinc, copper/chrome, potassium and mercury |

Further screening found a few commercially successful products that covered a broad range of biocides. Four such products (or series of products) are briefly describing in the ensuing paragraphs. These products can be utilized in differing embodiments of the present technology.

The Dow-Corning silicone quaternary amine, now called Microbe Shield, has broad-spectrum antimicrobial activity. The active ingredient (3-trimethixysilylpropyldimethyloctadecyl ammonium chloride) is a special version of Category 3 above, and controls a broad range of bacteria and fungi responsible for odors, rot, and mildew. This compound destroys microorganisms by disrupting the delicate cell membranes, and therefore, does not need to be absorbed in solution to be effective. In addition, the compound bonds to inert surfaces. This means that Microbe Shield remains effective after the substrate is cleaned. In one embodiment, a nonwoven web treated with this material holds the promise of long lasting effectiveness.

The Vancide® series of products from R. T. Vanderbilt Company, Inc., of Norwalk, Conn. 06855, are quite effective. However, at least two of them, Vancide MZ-96 (zinc dimethyldithiocarbamate) and Vancide 89, are rated "Highly Toxic" by the OSHA Hazard Communication Standard. They are also a Level 4 Health Hazard by both the Hazardous Material Information System and the NFPA standards. This means they must be handled with extreme care, especially if used in a manufacturing facility.

Troy Corporation makes zinc naphthenate and proprietary mixtures called Polyphase®. These products have a long, successful history with cellulose-based products.

A Dow Chemical product called Dowicide® is an orthophenyl-phenol This solid material can be used in another embodiment, such as in any number of dispersions, for implementing in an application to a nonwoven web such as described herein.

Five biocides were chosen for a comparative evaluation for inhibition activity against three common mold fungi. The evaluation was performed at the Forest Research Labs of Mississippi State University in Starkville, Miss. ("MSU") using a substantially modified version of ASTM G-21, termed the "The Agar-Plate Test Method". This method provides a rapid screening test for the evaluation of biocides against a wide variety of microorganisms.

Five (5) biocide compositions ("biocides") were evaluated using the Agar-Plate Test Method: (1) Microbe Shield, (2) Zinc Pyrithione (ZPT), (3) ortho-Phenyl Phenol, (4) Borogard ZB, and (5) a mixture evaluated of 50% Zinc Pyrithione with 50% Borogard ZB. These biocide compositions were added to autoclaved fungal media at different concentrations. The biocides do not have to be dissolved in the agar, only suspended. Plugs of specific fungi were inoculated onto agar plates containing the different biocides/concentrations. According to this method, the lowest biocide level that totally inhibits fungal growth is reported as the Minimal Inhibitory Concentration (MIC).

For terminology, "hypha" (singular) and "hyphae" (plural) is/are a loose network of delicate filaments in a fungus. "Mycelia" (singular) and "mycelium" (plural) (plus the adjective form "mycelial") is/are the main part of fungus, consisting of the feeding and reproducing hyphae, that forms the body of a fungus. Radial growth of a mycelia is measured and plotted against concentration. A linear regression is run to estimate the biocide concentration that inhibits radial growth by 50%. This Inhibitory Concentration is called the $IC_{50}$.

The five (5) different biocides that were involved in the comparative evaluations were tested at four (4) concentrations per biocide composition, plus a control (no biocide).

The biocides were tested against three common mold fungi (*Aspergillus niger, Cladosporium cladosporioides*, and *Penicillium funiculosum*) with five (5) replicates for every treatment combination. The biocides that were tested and their concentrations were (1) Microbe Shield at 0, 3, 15, 75 and 375 ppm ("Parts Per Million") ai ("Active Ingredient"); (2) Zinc Pyrithione at 0, 3, 15, 75 and 375 ppm ai; (3) ortho-Phenyl Phenol ("OPP") at 0, 3, 15, 75 and 375 ppm ai; (4) Borogard ZB at 0, 10, 50, 250, and 1250 ppm ai; and (5) the 50:50 mixture of Zinc Pyrithione and Borogard ZB at 0, 1.5/5.0, 7.5/25, 37.5/125, and 187.5/625 ppm ai.

Stock concentrations of each biocide were dissolved or suspended in water or acetone (only OPP was dissolved in acetone) to a concentration that allowed 1 ml of stock to be added to 250 ml of media in order to provide the highest required biocide concentration. Stocks were diluted in a 5 fold series to match the concentrations required. For each biocide concentration, 250 ml of Sabouraund Dextrose Agar in water was autoclaved and then cooled to 50° C. Then 1 ml of the appropriate biocide concentration was added to each flask. Control flasks received 1 ml of water or acetone (for OPP). Media was mixed, dispensed into Petri dishes and allowed to cool. Each biocide test used 90 agar plates including controls.

A 0.7 mm plug of agar was removed from every plate at the time of each study. A plug from an agar plate containing one of the fungi was inserted into the hole. The plug of fungi was taken from the leading edge of a fungal colony. Several plates of fungi were required for each study. The studies were grouped by fungi. The *Cladosporium cladosporioides* study began first; the *Aspergillus niger* study began next; and the *Penicillium funiculosum* study began last. Mycelial growth was measured for every plate in each study. Fast growing species were measured daily and slower growing species were measured every 2-3 days. All studies were carried for at least two weeks or until growth leveled out. Digital photographs were taken at different times during each fungal study.

The average for the five replicates of each biocide concentration was determined and the averages plotted as growth over time for each biocide. The growth at the measurement just prior to the control samples reaching full plate growth (maximum growth) was used to plot these growth averages against concentration on a semi-log scale. The linear portion of these lines was used in a linear regression to estimate the $IC_{50}$ and MIC for each biocide and fungal species. These results are shown in TABLE 2.

TABLE 2

Data Comparing Biocide Effectiveness

| | *Cladosporium cladosporioides* | | *Aspergillus niger* | | *Penicillium Funiculosum* | |
|---|---|---|---|---|---|---|
| Biocide Used | $IC_{50}$ (ppm) | MIC (ppm) | $IC_{50}$ (ppm) | MIC (ppm) | $IC_{50}$ (ppm) | MIC (ppm) |
| Microbe Shield | 2025[a] | 5575[a] | 286 | 625[a] | 670[a] | 1289[a] |
| OPP | 203.8[b] | 375[b] | 16.3 | 84.5 | 212.6[b] | 375[b] |
| Zn Pyrithione | 1.8[b] | 15[b] | 9.2 | 21.2 | 8.0 | 16.2 |
| Borogard | 1347[a] | 3158[a] | 2276[a] | 5336[a] | 557 | 1396[a] |
| 50:50 | 4.8/16.1 | 9.6/32.1 | 13.2/43.9 | 32.5/108.4 | 3.5/11.5 | 8.0/26.7 |

In Table 2, the numbers denoted as "a" are an extrapolation outside of the test concentration range. For numbers denoted as "b", the $IC_{50}$ and MIC are probably less than the reported numbers. There was mycelial growth at the lower concentration, but no mycelia grew at the upper concentration. Therefore, inhibition could have actually occurred at a concentration somewhere in between. Since these estimates are only based on two points, it is impossible to estimate where true inhibition occurred without repeating the experiment at intermediate concentrations.

The data collected and shown in Table 2 indicates, surprisingly, that Zinc Pyrithione was most suitable for further studies and for use in manufacture of a nonwoven web. Zinc Pyrithione was more powerful than even ortho-Phenyl Phenol (OPP), which has long been a standard fungicide in the preservation of cellulose, especially wood. Ortho-Phenyl Phenol (OPP) is, at best, suspected of being harmful to humans, while Zinc Pyrithione is the active ingredient in most anti-dandruff shampoos.

In view of the foregoing evaluation, it was decided to continue work utilizing either Sodium Pyrithione or Zinc Pyrithione. The major USA producer of these products is Arch Chemicals, Inc. of Cheshire, Conn. 06410, whose "Zinc Omadine®" brand zinc pyrithione product is hereinafter referred to hereinafter as "ZPT". The basic formula for ZPT (zinc pyrithione) is $C_{10}H_8N_2O_2S_2Zn$. For use in a coating, the product is supplied as a 48% solids content aqueous dispersion. The particle size is 100% at 5-microns or less, and 90% at 1-micron or less. This dispersion is very stable, having a long shelf-life.

FIG. 1 shows a first example embodiment of apparatus for forming a nonwoven web to which a biocide such as ZPT can be applied. As illustrated in FIG. 1, a typical batch of papermaking stock can be made by utilizing a large type waste paper disintegrator 20, as used by any waste paper mill (such as a Hydrapulper® type waste paper disintegrator, for example). This "Pulper" is charged with about 5000 gallons of water, to which is added about 1900 pounds of OCC (Old Corrugated Container). The water/OCC mixture is pulped until the big clumps are disintegrated. To the pulped mixture is added about 1200 pounds of Mixed Waste paper and another 5000 gallons of water. The resulting stock is now at about 3.6% consistency (% solids).

As soon as this blend is well mixed, it is passed through cleaning and clump removal screens 22 into a first holding chest 24. This is followed by a stock refiner 26, and then the stock is pumped to a second holding chest 28. From the second holding chest 28, the stock is diluted somewhat before passing through a Selectifier® screen to remove smaller clumps, and then several cleaners to remove foreign objects such as metal (the Selectifier® and subsequent screens being illustrated as 30 in FIG. 1). The stock is further diluted at a fan-pump 32 to about 0.8% consistency, and then introduced to a paper-forming machine 40. A paper forming machine 40 can comprise any suitable apparatus, such as a Fourdrinier, a single cylinder, or a multiple cylinder vat machine, for example. After initial stock dilution, various processing aids such as retention aids, drainage aids, and defoamers may be added as needed to the paper forming machine.

Following the forming apparatus of a paper forming machine 40, the sheet formed is pressed by a standard mechanical paper wet-press section 42, and then the web is introduced to a typical steam-heated dryer section 44. After the web is dried, it is fed as a flexible web to a reel forming winder 46, followed by a more precise reel forming device known as a rewinder 48. Thus the web has flexibility sufficient for the web to be wound on a roll. The re-winder 48 can perform various functions, such as trim web edges and slit web width (Often the wide web is slit into narrower rolls during the re-winding process).

In the apparatus of FIG. 1, the steam-heated dryer section 44 comprises a size press 50 and multiple steam-can driers 52. The size press 50 is typically located downstream from the entrance to the steam-heated dryer section 44 and is situated at about 66% to 75% of the length of the steam-heated dryer section 44 from the entrance. The size press 50 can be realized in several configurations. In a first mode and embodiment, biocide is applied to one surface of a nonwoven web at the size press 50, as shown in FIG. 1. The biocide for treating a nonwoven mat can be any suitable biocide, such as (for example), the ZPT (zinc pyrithione), OPP (ortho-Phenyl Phenol), or Microbe Shield, or the Vancide® series of products from R. T. Vanderbilt Company, Inc., or the Troy Corporation's proprietary mixtures called Polyphase®, all mentioned above.

Figure 2C:
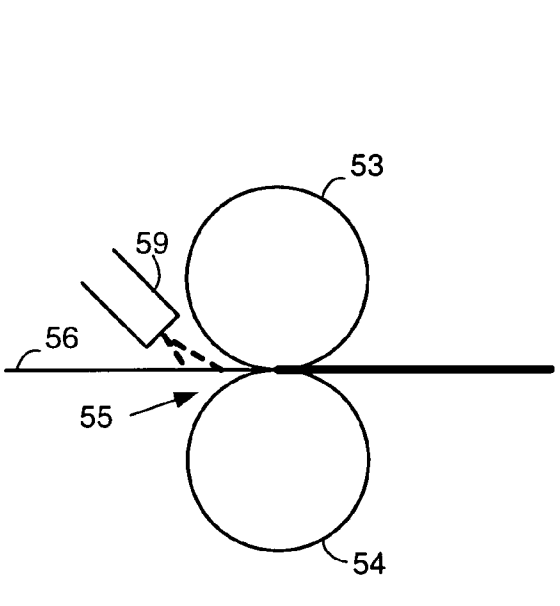
FIG. 2A, FIG. 2B, and FIG. 2C are diagrams illustrating a differing configurations of a size press which can be utilized for application of a biocide in the embodiment of FIG. 1.
Figure 2B:
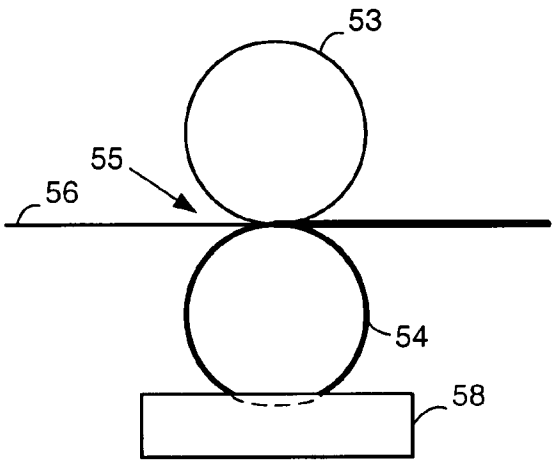
Figure 2A:
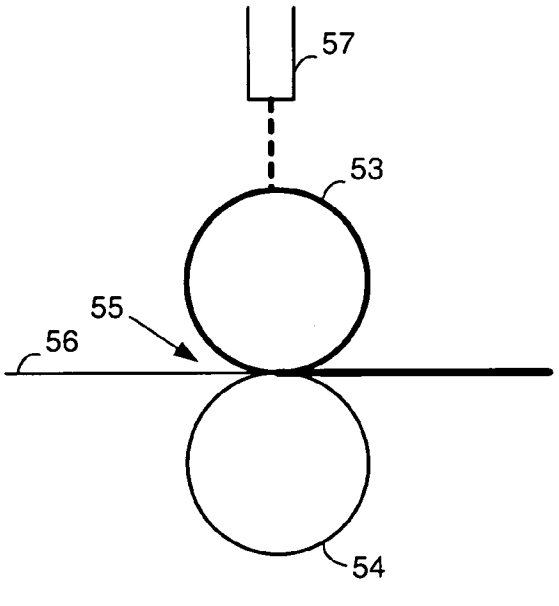

As shown in FIG. 2A, an example size press 50 includes two cylindrical rotatable rollers 53, 54 positioned with their major axes being parallel and separated to form a nip 55 between which the nonwoven web substrate 56 is transported or conveyed. In the example configuration of FIG. 2A, a header 57 or the like discharges biocide onto one roller 53. The biocide is applied to one surface of the web 56 as the roller 53 rotates. In another example configuration of FIG. 2B, the bottom roller 54 laps up biocide from a pan or reservoir 58 which is situated beneath bottom roller 54, with the biocide being applied to an underside of web 56 as roller 54 rotates. In yet another example configuration of FIG. 2C, a nozzle or fountain sprays biocide on a surface of the web 56 proximate the nip 55. The nip 55 is accurately set so that the biocide application is uniform over the applied surface of web 56. It will be appreciate by those skilled in the art that further apparatus and structures can be employed in conjunction with one or more of these example configurations, such as a blade or scraper positioned downstream of the rollers 53, 54 to remove excess biocide, for example.

As mentioned above, the example apparatus of FIG. 1 and any suitable biocide can be used for treating a nonwoven mat. Such biocides include but are not limited to those mentioned and evaluated, e.g., ZPT (zinc pyrithione), OPP (ortho-Phenyl Phenol), and Microbe Shield. One particular set of trials for producing a biocide-treated nonwoven felt product which utilized the example apparatus of FIG. 1 and the procedures and inputs described in conjunction therewith were conducted at the Herty Research Foundation in Savannah, Ga., utilizing a paper machine's "Size-Press" to apply various levels of biocide ZPT (zinc pyrithione) to nonwoven web which had been produced essentially in the manner described above. A large number of differing levels of treatment were made and samples of each dosage rate retained.

In order to establish a range of dosage levels that might quantify their effectiveness, four (4) dosage levels were utilized: (a) 62-grams/MSF; (2) 86-grams/MSF; (3) 116-grams/MSF, and (4) 123-grams/MSF; plus a zero grams/MSF(0) control. The unit of measure: "per MSF" or per "Thousand Square Feet", rather than a unit of weight; e.g., "per Ton", is the most common unit of sale for many special nonwoven webs.

After the biocide was applied to the nonwoven web at the varying dosage levels, two different testing facilities were used to evaluate these samples: The Forest Research Labs of Mississippi State University (MSU), and the laboratory of Arch Chemicals, Inc. ("Arch"). MSU evaluated the treated samples for resistance to mold using testing procedures of, e.g., ASTM D 6329-98, "Standard Guide for Developing Methodology for Evaluating the Ability of Indoor Materials to Support Microbial Growth Using Static Environmental Chambers," and Arch Chemicals utilized ASTM G 21-96 (Re-approved 2002), "Standard Practice for Determining Resistance of Synthetic Polymeric Materials to Fungi", both from ASTM International, PA, USA.

The MSU testing used the fungus *Stachybotrys chartarum*, but allowed "other molds" to enter the chamber. The *Stachybotrys chartarum* (ATCC 9182) was grown on Potato Dextrose Agar ("PDA") and Sabouraud Dextrose Agar and allowed to sporulate (i.e., produce spores). This procedure followed ASTM C 1338-00, Standard Test Method for Determining Fungi Resistance of Insulation Materials and Facings. ASTM International, PA., USA. The solution was adjusted with additional sterile water until a spore count of approximately 940,000 cells per ml was obtained. This solution was the inoculum. A portion of this solution was also plated onto PDA to confirm the viable cell count. In the test, the nonwoven felt pieces were laid out with their treated side up, and inoculated with the spore suspension by an atomizer (ASTM C 1338-00). The pieces were allowed to air dry for several hours before being placed into the static environmental chambers. There were five replicates for each sample set (62-grams/MSF; 86-grams/MSF; 116-grams/MSF, and 123-grams/MSF; plus a zero (0) control) for each sampling period (2 weeks, 4 weeks, and 6 weeks).

While this testing project was designed to evaluate only one specific mold type; i.e., *Stachybotrys chartarum* (ATCC 9182), the accidental inclusion of "other molds" provided an opportunity to see how the biocides reacted to these intruders; e.g., the "other molds" proved to be much harder to kill than the *Stachybotrys chartarum*.

The results of the MSU test is shown in TABLE 3. The numbers in Table 3 are in colony forming units (CFUs), a well known standard of measure prescribed, e.g., by ASTM 6329-98.

Results of the Arch Chemicals, Inc. study are shown in TABLE 4 for five samples, with results shown for both top and bottom surfaces of the nonwoven web. The numbers in Table 4 are explained in terms of a Growth Rating Scale for the mold wherein 0=No growth; 1=Trace growth (<10% coverage); 2=Light growth (10 to 30% coverage); 3=Medium growth (30 to 60% coverage); 4=Heavy growth (60 to 100% coverage).

TABLE 3

The Evaluation Conducted by MSU; ASTM D 6329-98

| | Week Number 2 | | Week Number 4 | | Week Number 6 | |
|---|---|---|---|---|---|---|
| | *Stachybotrys* | Other Mold | *Stachybotrys* | Other Mold | *Stachybotrys* | Other Mold |
| Control (No ZPT) | 2760 | 4870 | 2830 | 6660 | 9640 | 48040 |

TABLE 3-continued

The Evaluation Conducted by MSU; ASTM D 6329-98

| | Week Number 2 | | Week Number 4 | | Week Number 6 | |
|---|---|---|---|---|---|---|
| | *Stachy-botrys* | Other Mold | *Stachy-botrys* | Other Mold | *Stachy-botrys* | Other Mold |
| 62-g/MSF | 0 | 880 | 680 | 3360 | 3710 | 19730 |
| 86-g/MSF | 0 | 530 | 390 | 3450 | 1110 | 4100 |
| 116-g/MSF | 0 | 67 | 0 | 125 | 0.2 | 7540 |
| 123-g/MSF | 0 | 0 | 0.4 | 54 | 0 | 5380 |

TABLE 4

The Evaluation Conducted by ARCH; ASTM G 21

| Sample ID and ZPT Content | | ASTM G-21 Rating | | | |
|---|---|---|---|---|---|
| Sample Number & Orientation | ZPT, g/MSF of paper | Week 1 | Week 2 | Week 3 | Week 4 |
| 1 - Top | 26 | 1, 1 | 1, 1 | 1, 1 | 1, 2 |
| 1 - Bottom | 0 | 2, 1 | 2, 2 | 3, 3 | 3, 3 |
| 2 - Top | 62* | 0, 0 | 0, 0 | 0, 0 | 0, 0 |
| 2 - Bottom | 0 | 1, 1 | 2, 2 | 3, 3 | 3, 3 |
| 3 - Top | 84 | 0, 0 | 0, 0 | 0, 0 | 0, 0 |
| 3 - Bottom | 0 | 4, 4 | 4, 4 | 4, 4 | 4, 4 |
| 4 Top | 116* | 0, 0 | 0, 0 | 0, 0 | 0, 0 |
| 4 Bottom | 0 | 1, 1 | 2, 2 | 2, 3 | 2, 3 |
| 5 Top | 128 | 0, 0 | 0, 0 | 0, 0 | 0, 0 |
| 5 Bottom | 0 | 1, 1 | 2, 3 | 2, 3 | 2, 3 |

The Arch results of Table 4 show that, with the exception of the sample having the lowest biocide dose at 26 grams ZPT per MSF (and had growth on both sides), all the nonwoven felt samples were resistant to fungal growth via ASTM G 21 on one side (the top side), but not on the opposite side (the bottom side). However, the MSU results showed that mold DOES grow at the biocide dose of 62-grams ZPT per MSF. The Arch study, where both sides were tested, reflects the fact that some biocide was inadvertently applied to the bottom side of the nonwoven continuous web.

From Table 3 and Table 4 it appears that significant mold resistance is imparted when 50-grams or more of biocide, e.g., ZPT, is applied per MSF per side to the nonwoven continuous web. Mold resistance is optimum when 100-grams or more of biocide (e.g., ZPT) is applied per MSF (per side) to the nonwoven continuous web. However, the amount of biocide added may be controlled in accordance with manufacturing and application objectives. For example, minimum amount of added biocide will resist the growth of fungi, while a higher dose of the same biocide may actually kill already formed fungi. Killing already formed fungi can be particularly important when the recycled paper or cellulose has been obtained from a dirty waste paper source.

Figure 3:
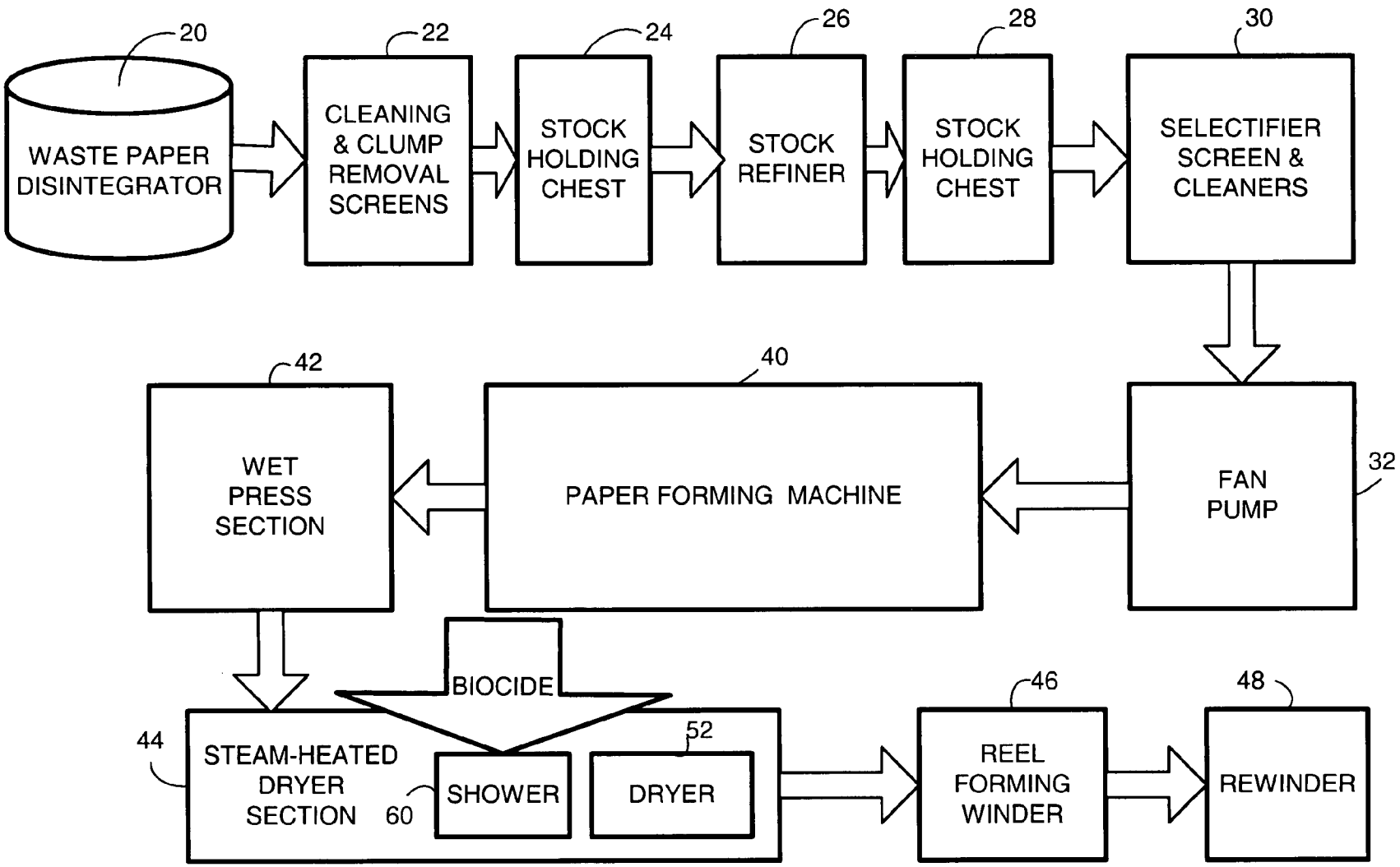
FIG. 3 is a schematic view of web making apparatus according to a second example embodiment of the technology.
Figure 4:
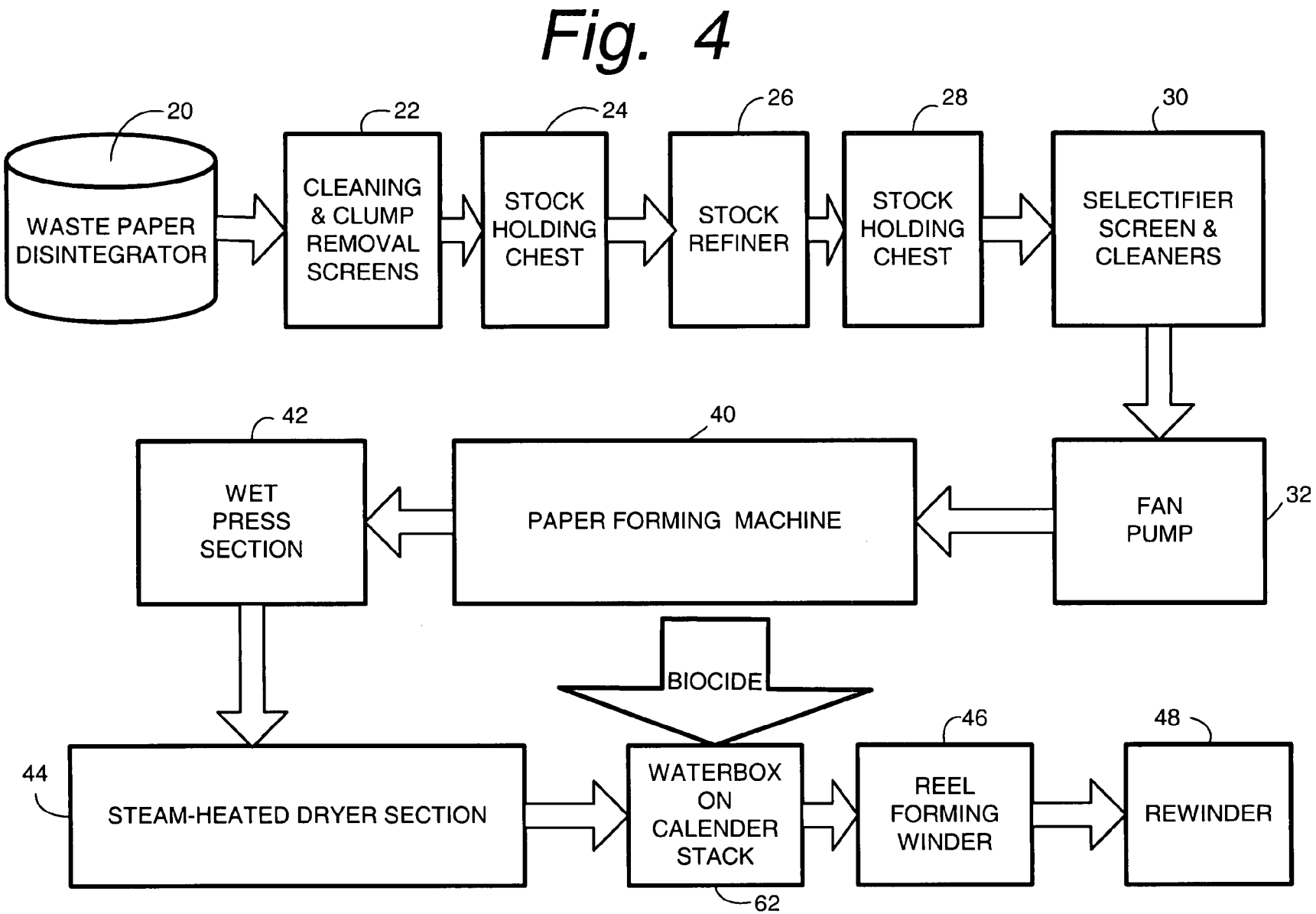
FIG. 4 is a schematic view of web making apparatus according to a third example embodiment of the technology.

While stock preparation systems have used biocides for many years to control unwanted mold inside the whole papermill, treatments designed to resist mold growth in the end-use market should not be added prior to web formation. Chemicals that modify the performance of this nonwoven web can be introduced to the sheet during fabrication anywhere, but preferably are added to an already-formed web after the wet-press section. In this regard, the example embodiment of FIG. 1 shows the biocide (e.g., ZPT) being added at a size-press 50. In place of a typical low-solids size-press, a high-solids on-machine coater can be utilized in approximately the same position. The example embodiment of FIG. 3 shows biocide (e.g., ZPT) being added at a shower 60. The shower 60 is situated in a similar location to size press 50 and just upstream from multiple steam-can driers 52. The example embodiment of FIG. 4 shows biocide (e.g., ZPT) being added at a waterbox on a calender stack (illustrated as 62 in FIG. 4). The waterbox on a calender stack 62 is positioned between the steam-heated dryer section 44 and the reel forming winder 46. The waterbox is a trough on a nip roller of the stack of calender rolls, with the web extending in serpentine configuration through the calender rolls.

Figure 5:
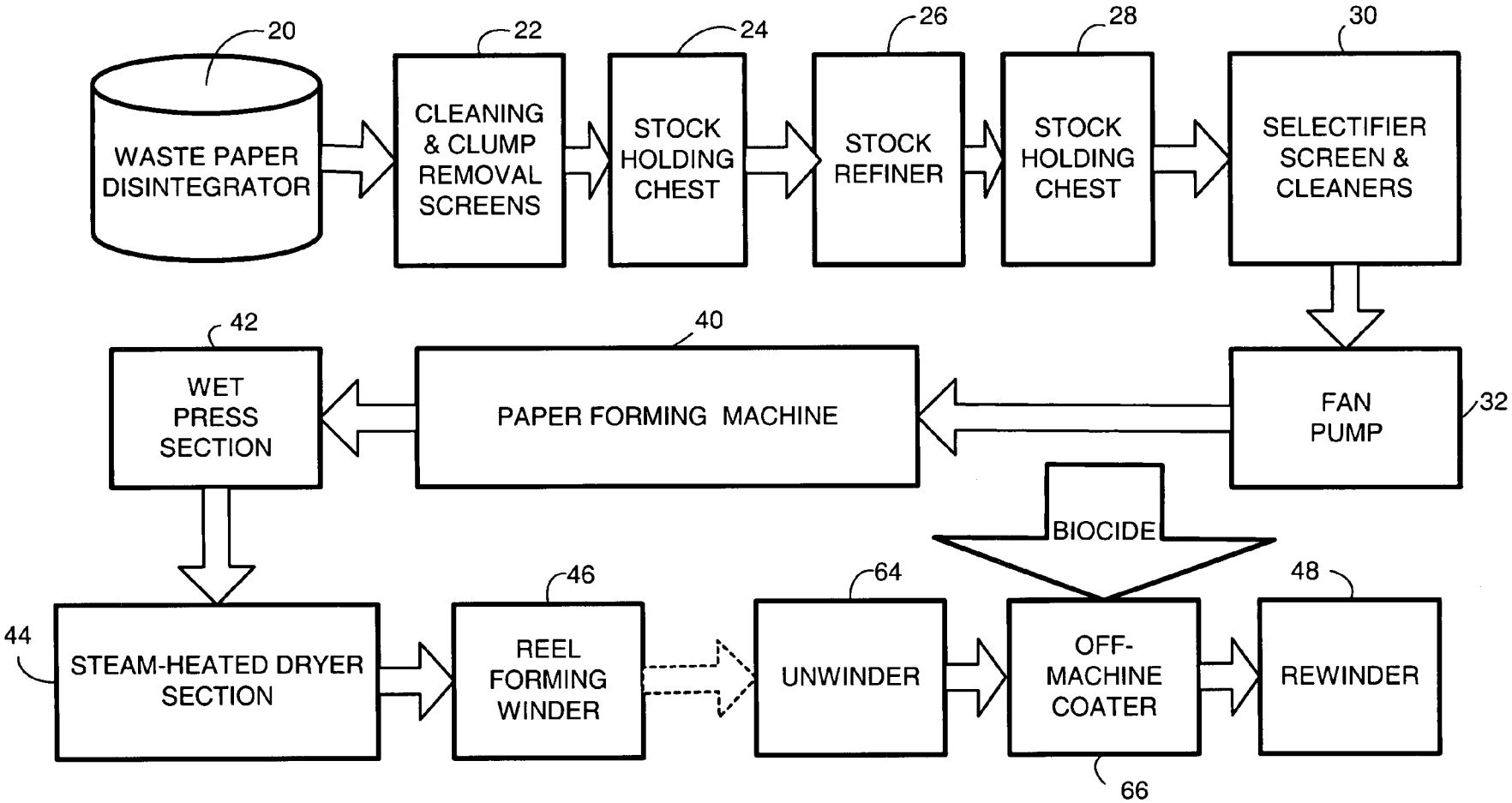
FIG. 5 is a schematic view of web making apparatus according to a fourth example embodiment of the technology.

Modifying chemicals such as the biocide (e.g., ZPT) can also be added in a subsequent process, such as by a so-called "off-machine" coater 66 as illustrated in FIG. 5. The web is taken from reel forming winder 46, and then introduced into an unwinder 64 and then through coater 66 where the biocide is applied. The web is then fed to rewinder 48.

Figure 6:
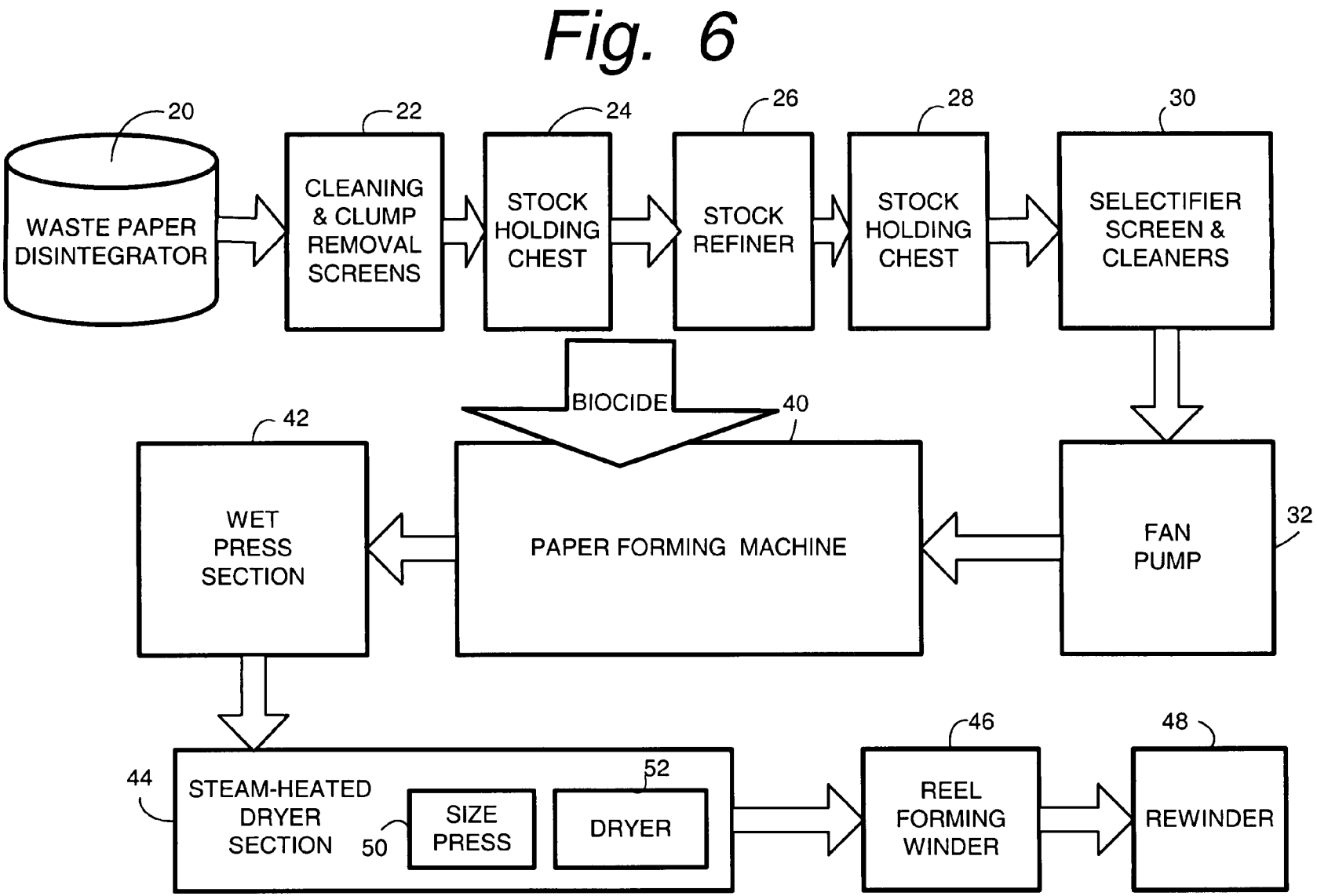
FIG. 6 is a schematic view of web making apparatus according to a fifth example embodiment of the technology.

Generally, for optimum effectiveness, biocide treatment is best added to the nonwoven web after it has been formed. However, it is possible to add biocides to the papermaking stock just prior to, or during, web formation, as illustrated in FIG. 6. For example, the makers of Microbe Shield claim that it will "bond" to cellulose fibers, and remain bonded and effective throughout washings or rain storms. Still, a lot of fibers leave the paper mill in the effluent water, and will carry biocide with them. Any biocides in the effluent water may kill microbial action, which is undesirable in some cases. Some water clarifying systems require certain microbial activity to be effective. Therefore, adding the biocides during, or before, web formation is a possible embodiment for those who do not want microbial activity in their water clarification system. Furthermore, since this addition point will always split the total biocide dose added into some ratio between staying with the nonwoven web and staying with the effluent water, this method would be the preferred embodiment if the manager wanted to kill microbial activity in the water clarifying process.

A biocide such as ZPT can be added during the web fabrication process or (more preferably and depending, e.g., on type of biocide and environmental or waste concerns) after such process. In the most preferred mode, a biocide is added at a size-press or "on-machine" coater Another preferred mode comprises a well-designed spray system such as made by V-I-B Systems of Atlanta, Ga. The major control mechanism for the amount of biocide added will usually be the concentration of the liquid material.

Another distinguishing feature of the present technology is that the nonwoven web is, on average, heavier than prior art biocide treated nonwoven webs. By "heavier", it is meant that the "Basis Weight" of the nonwoven web of the current technology is generally in excess of thirty (30) pounds per one-thousand (1000) square feet (abbreviated 30-lbs./MSF). Most nonwoven webs currently in service as biocide-treated sheets weigh about half of that; e.g., 15-lbs/MSF.

The nonwoven web of the present technology may contain some virgin cellulose fiber. However, as a distinctive difference over the nonwoven webs of the prior art, the webs of the present technology utilize at least 40% of the low quality waste paper, e.g., Mixed Waste and "OCC" (Old Corrugated Container). While some of the white, or at least the light-colored, webs of the prior art do use recycled scrap paper, they do not use "Mixed Waste" or "OCC". The recycled scrap paper furnish used by the prior art webs may be "Office Waste" or even "De-Inked" stock, but they do not use as much as forty percent (40%) of the low quality recycled cellulose.

While in the examples illustrated above a biocide is applied only to one surface of a nonwoven web, the technology herein described also encompasses modes wherein the biocide is applied to both opposed surfaces of a nonwoven web. Such may be desirable, for example, when the nonwoven web serves as builders felt or the like, particularly when not treated with asphalt. On the other hand, in some utilizations such as a facer for a polyisocyanurate lamination board, the foam-adhered surface of the web need not have the biocide, with the result that only one surface of the web need have the biocide applied.

Thus, described herein are nonwoven webs having a biocide and methods of making the same. The webs may be employed for all forms of building construction products to impart at least some resistance to molds and fungi growth. The web can be (for example) a facer for continuously laminated foam board, or a "Builder's Paper" (a.k.a. "Dry Felt"), or a nonwoven web felt underlayment, that has at least a measurable level of resistance to molds and fungi growth. In addition to web ingredients already described, it should be understood that the web may also comprise glass fibers, either recycled glass and/or virgin glass.

Although various embodiments have been shown and described in detail, the claims are not limited to any particular embodiment or example. None of the above description should be read as implying that any particular element, step, range, or function is essential such that it must be included in the claims scope. The scope of patented subject matter is defined only by the claims. The extent of legal protection is defined by the words recited in the allowed claims and their equivalents. It is to be understood that the invention is not to be limited to the disclosed embodiment, but on the contrary, is intended to cover various modifications and equivalent arrangements.

What is claimed is:

1. A process of making a nonwoven web comprising:

introducing a furnish comprising at least forty percent (40%) recycled waste paper into a paper forming machine to produce a web substrate having a weight sufficient for construction industry use, the web substrate being susceptible of being wound by a reel forming device; and then applying a biocide to at least one surface of the web substrate.

2. The process of claim 1, further comprising applying the biocide at a size press.

3. An article produced by the process of claim 2.

4. The process of claim 1, further comprising applying the biocide at a shower of a steam-heated dryer.

5. An article produced by the process of claim 4.

6. The process of claim 1, further comprising applying the biocide at a waterbox of a calender roll.

7. An article produced by the process of claim 6.

8. The process of claim 1, further comprising applying the biocide after a wet-press section.

9. An article produced by the process of claim 8.

10. The process of claim 1, further comprising applying the biocide at a coater.

11. An article produced by the process of claim 10.

12. An article produced by the process of claim 1.

13. The process of claim 1, wherein the biocide comprises zinc pyrithione; ortho-Phenyl Phenol; or, a silicone quaternary amine with an active ingredient 3-trimethixysilylpropyldimethyloctadecyl ammonium chloride.

14. The process of claim 1, wherein the web comprises builders felt.

* * * * *